US006460568B1

(12) United States Patent
Goodwin

(10) Patent No.: US 6,460,568 B1
(45) Date of Patent: Oct. 8, 2002

(54) MULTI-LUMEN MANIFOLD

(75) Inventor: Clive Goodwin, Northern Ireland (GB)

(73) Assignee: Valpar Industrial Limited, Northern Ireland (GB)

( * ) Notice: Subject to any disclaimer, the term of this patent is extended or adjusted under 35 U.S.C. 154(b) by 0 days.

(21) Appl. No.: 09/554,769

(22) PCT Filed: Nov. 19, 1998

(86) PCT No.: PCT/GB98/03439

§ 371 (c)(1),
(2), (4) Date: Jul. 26, 2000

(87) PCT Pub. No.: WO99/25640

PCT Pub. Date: May 27, 1999

(30) Foreign Application Priority Data

Nov. 19, 1997 (GB) ..... 9724399
Feb. 4, 1998 (GB) ..... 9802274

(51) Int. Cl.[7] ..... B67D 5/62
(52) U.S. Cl. ..... 137/561 A; 137/597; 222/146.6
(58) Field of Search ..... 137/561 A, 597, 137/883, 561 R; 222/129.1, 146.6

(56) References Cited

U.S. PATENT DOCUMENTS

| | | | | | |
|---|---|---|---|---|---|
| 2,163,591 | A | * | 6/1939 | Deverall | 137/561 A |
| 3,785,402 | A | * | 1/1974 | Collier | 137/561 A |
| 4,781,309 | A | * | 11/1988 | Vogel | 222/129.1 |
| 4,913,183 | A | * | 4/1990 | Vogel et al. | 137/15 |
| 4,955,409 | A | * | 9/1990 | Tokuda et al. | 137/561 A |
| 5,209,259 | A | * | 5/1993 | Dear et al. | 137/561 A |
| 5,279,446 | A | * | 1/1994 | Cook et al. | 222/146.6 |
| 5,782,222 | A | * | 7/1998 | Morris et al. | 123/456 |
| 6,062,308 | A | * | 5/2000 | Flood | 166/52 |

* cited by examiner

*Primary Examiner*—A. Michael Chambers
(74) *Attorney, Agent, or Firm*—Ronald E. Greigg

(57) ABSTRACT

A manifold has one or more inlets and one or more outlets. An elongate hollow core of the manifold is divided longitudinally into a plurality of lumens by one or more elongate partitioning members extending across the manifold core to enable flow of the liquid to be directed laterally around the manifold from the or each inlet to the or each outlet. A gated valve gated assembly is adapted for use with a beverage distributing manifold having a plurality of longitudinally separate lumens. The valve assembly includes a hollow body having an inlet and an outlet for the passage of liquid therethrough to a distribution port. The valve body is transversely movable within and across the manifold to separately locate the inlet in each lumen.

38 Claims, 5 Drawing Sheets

MULTI-LUMEN MANIFOLD

BACKGROUND OF THE INVENTION

1. Field of the Invention

This invention relates to improvements for manifolds used in the drinks industry, particularly but not exclusively for the distribution of beverages.

2. Description of Prior Art

One form of multiple beverage distribution is a dispense tower having a number of branch outlets connectable to the taps to supply the same or different drinks to each tap. Where the drinks have the same major constituent, e.g. still or carbonated water, this is supplied to all the outlets through a common manifold.

As shown and discussed in GB-A-2271619, a standard manifold has poor flow characteristics, creating pockets of possible stagnation of water therein, and unequal pressure delivery across the outlets. The invention in GB-A-2271619 is a 'tube-in-tube' manifold designed to create a better equalising flow across the outlets by directing the flow around the manifold between the inlet and outlet delivery lines. However, manufacture of the usually metallic tube-in-tube manifold requires the separate formation of the tubes, conjunction of the tubes, and the creation and addition of extra dimples to hold and centralise the inner tube in place. Manufacture is not therefore simple or flexible.

SUMMARY OF THE INVENTION

An object of the present invention is to achieve the same or a similar effect as the tube-in-tube manifold, but with significantly easier manufacture.

According to one aspect of the present invention, there is provided a manifold having one or more inlets and one or more outlets, wherein the elongate hollow core of the manifold is divided longitudinally into a plurality of lumens by one or more elongate partitioning members extending across the manifold core to enable flow of the liquid to be directed laterally around the manifold from the or each inlet to the or each outlet.

By dividing the manifold longitudinally along its core, liquid can be directed laterally from one end to the other, or at least along and across the apertures for any branch outlets, avoiding stagnation and equalising distributing temperature and pressure.

The partitioning member(s) may be separate or integral with the manifold, preferably supported in place by the manifold body wall, either directly or with intermediate supporting means. Where separate, the partitioning member (s) could be readily and easily insertable into one end of the manifold which is then sealed. A separate partitioning member would preferably be supported in place across the core by interference fit the manifold wall, although loose or looser fitting could be used for certain applications.

Preferably, the partitioning member(s) are formed integrally with the main body of the manifold, e.g. by plastics extrusion. Thus according to a second aspect of the present invention, there is provided a manifold whose elongate hollow core is divided longitudinally into a plurality of lumens by one or more partitioning members extending across the manifold, wherein the body of the manifold and the or each partitioning member are integrally formed by plastics extrusion. The partitioning member(s) are then inherently supported in place by the manifold body wall (s). The ends of the manifold body can then be sealed eg. using end caps More preferably, the manifold uses one partitioning member, which, depending upon its shape is able to divide the manifold core into two, three, four or more lumens.

Each lumen may be separate from each other lumen, or be able to direct liquid flow into one or more other lumens through common passages. Where the manifold includes two or more separate lumens or sets of lumens, each separate lumen or each set of lumens will have a separate inlet and outlet. More than one inlet and/or more than one outlet may be used for each lumen or each set of lumens.

The partitioning member(s) may include slits, perforations or other apertures therein to increase or disturb the flow of liquid to and/or around the neighbouring lumen(s). The partitioning members) may extend wholly or substantially along the length of the manifold core. Where a partitioning member extends only substantially along the length, liquid can flow into one or more other lumens within the remaining common passage in the core. Where a partitioning member extends to the ends of the manifold core, and the passage of liquid to one or more other lumens is desired, apertures can be created in the one or both ends of the members, or one or both ends of the members can be cut away, to allow such flow.

Most liquid circulating manifolds have one delivery inlet and one delivery outlet. Whilst in the present invention, an inlet and a corresponding outlet could be coupled to the same lumen, with possibly a barrier in the lumen therebetween to prevent direct inlet to outlet flow, the manifold preferably has one inlet coupled to one or more lumens, and one outlet coupled to at least one different but connected lumen.

The inlet(s) and outlet(s) could also be positioned anywhere around or along the manifold, either separately or neighbouring. Preferably, the or each inlet and the or each corresponding outlet are neighbouring and parallel.

According to one embodiment of the present invention, the manifold has one inlet and one neighbouring and parallel outlet, and a partitioning member integrally formed across and substantially along the length of the manifold core to create two lumens with connecting ends, wherein the inlet is coupled to one lumen and the outlet is coupled to the other lumen.

The manifold may be used to distribute a beverage to a plurality of branch outlets, apertures to which are spaced in the manifold body along the side of one lumen. The term "beverage" as used herein includes a beverage component used to create a vendible beverage, e.g. still water, carbonated water, etc.

The manifold may also be used to circulate a coolant around the manifold to cool the surrounding environment, neighbouring components and/or neighbouring liquids. Such cooling includes trace cooling of any adjacent supply lines, and conduction cooling of the beverage dispensing heads or taps through the use of metal blocks or ferrules thereinbetween. The dispensing heads or taps preferably attach or connect directly with the metal blocks or ferrules, and the blocks or ferrules fit wholly or substantially around the manifold.

The manifold of the present invention has a further advantage, in that it can be sized to conveniently fit into the existing housings and shells of drinks-dispensing apparatus such as towers. This is particularly so for the internally divided cooling manifold as herein described, which can be considerably more compact and convenient to fit and use for the same amount of cooling than the single-bore cooling tubing currently used, which has to be bent into a T-shape with consequent space and flow problems.

Thus, according to a third aspect of the present invention, there is provided an is integral tower cooling assembly comprising an internally divided cooling manifold and one or more conjoined metal ferrules adapted to connect with and supply cooling to one or more dispensing taps, the manifold and the or each ferrule being held together by a rigid insulative surround.

Such a cooling assembly could be immediately ready for installation into a tower housing, requiring no further fittings or connections therewithin. The internally divided cooling manifold may have any suitable arrangement, eg. as shown in GB-A-2271619. Preferably, the cooling manifold is divided longitudinally into a plurality of lumens as herein described.

According to a fourth aspect of the present invention, there is provided a gated valve assembly adapted for use with a beverage distributing manifold having a plurality of longitudinally separate lumens, wherein the valve assembly includes a hollow body having an inlet and an outlet for the passage of liquid therethrough to a distribution port, the valve body being transversely moveable within and across the manifold to separately locate the inlet in each lumen.

The gated valve assembly allows the separate passage of the liquid in each lumen to the outlet of the valve body, and hence to the distribution port. One manifold can thus supply two or more different beverages, and the supply to each distribution port can be altered as desired or necessary.

The inlet of the valve body is preferably smaller than the transverse width of each lumen. The inlet may also be smaller than the separation between the lumens, to prevent any flow between the lumens when moving the valve body. Alternatively, the inlet is sized and/or shaped so as to allow the passage of liquid from two or more lumens simultaneously.

The valve assembly is preferably supported by housing on one or both sides of the manifold. The distribution port could be coupled to the housing, and the housing could support and guide movement of the valve body.

In one embodiment of the gated valve assembly, the manifold is divided longitudinally by one or more elongate partitioning members across the manifold core to create the lumens as described hereinbefore.

The manifold and gated valve assembly may be made from any suitable material or combination of materials. Preferably, the manifold and gated valve assembly are made of plastic, e.g. a mouldable plastic such as thermoplastic, more preferably polyethylene. The plastic components can be welded together using known welding techniques. A plastic material is preferred in view of its cheapness, flexibility, and ability to be extruded, e.g. to form the main body of manifold as one piece.

Embodiments of the present invention will now be described by way of example only and with reference to the accompanying drawings in which.

Figure 1:
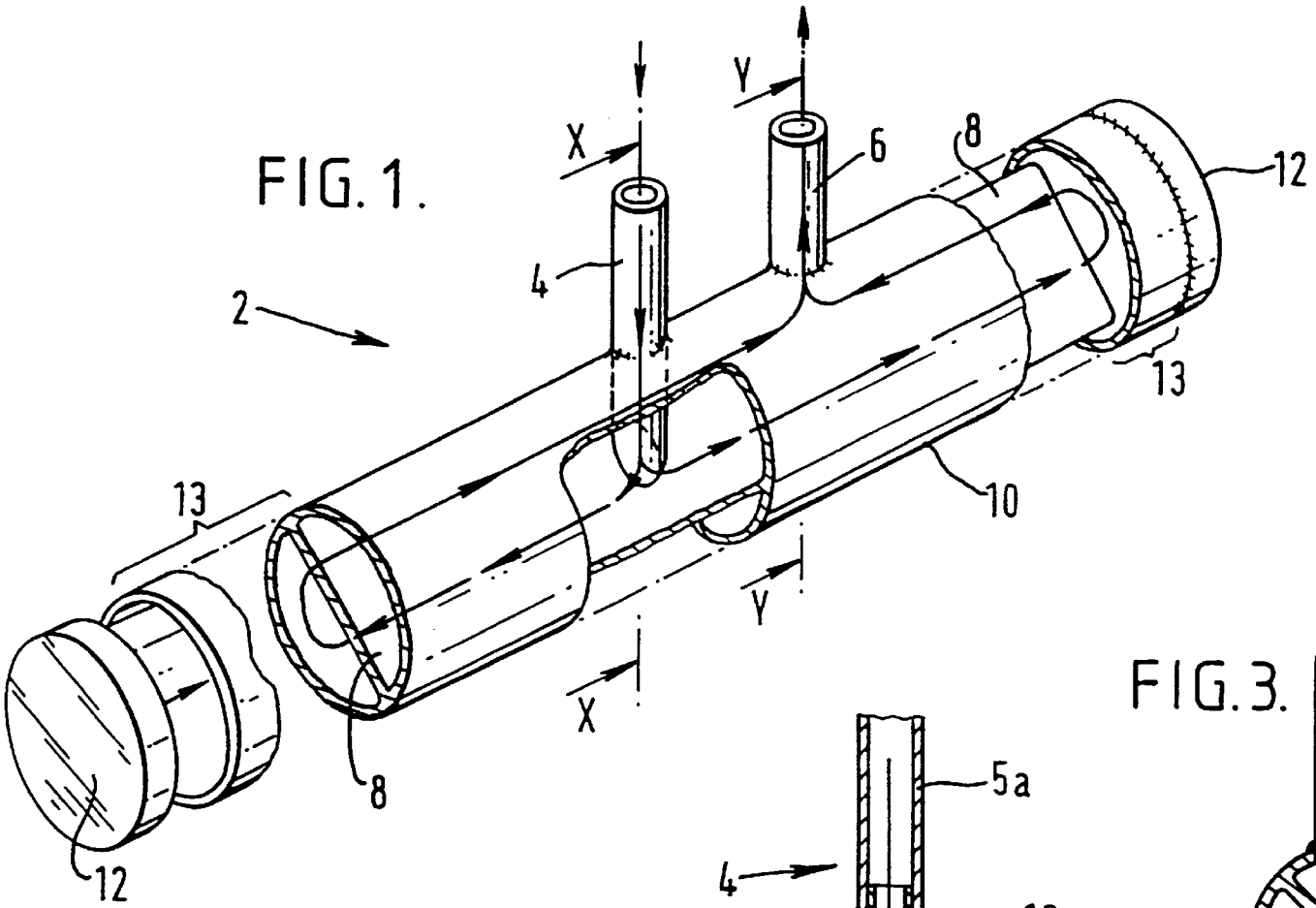
FIG. 1 is a perspective part cross-sectional view of a manifold according to one embodiment of the present invention.

Referring to the drawings,. FIG. 1 shows on all plastic manifold 2 having an inlet delivery line 4 and an outlet delivery line 6. The hollow core of the manifold 2 is divided longitudinally into two elongate lumens, a1 and b1, by a transverse partitioning member 8. The partitioning member 8 has been extruded simultaneously with the main body 10 of the manifold 2. The partitioning member 8 is therefore integral with the main body 10 and supported thereby.

Plastic end caps 12 are welded to each end of the main body 10 of the manifold to seal each end and to create a water-tight and pressure-tight enclosure. To create a passageway for liquid between the lumens al, b1, the final portions 13 of the partitioning member 8 at each end are cut away prior to the addition of the end caps 12.

Figure 3:
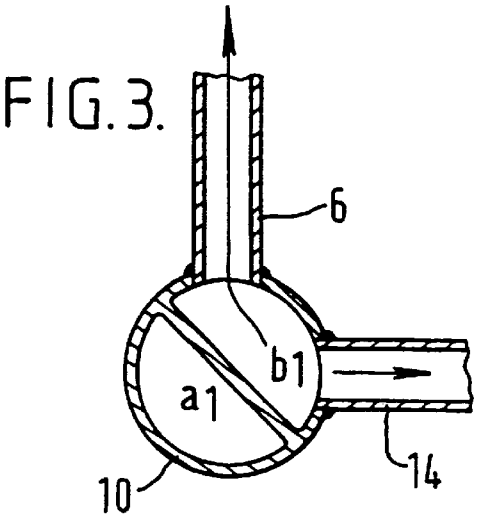
FIG. 3 is a cross-section along line Y—Y in FIG. 1 with a branch piece attached.
Figure 2:
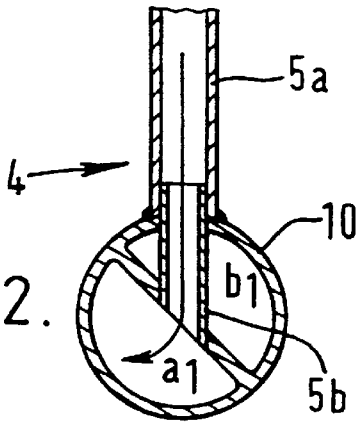
FIG. 2 is a cross-section along line X—X in FIG. 1.

The plastic inlet and outlet lines 4, 6 are then added to the manifold 2 by known welding techniques. As shown in FIGS. 2 and 3, the inlet line 4 is coupled with the lower lumen al, and the outlet line 6 is coupled with the upper lumen b1. Thus, the inlet and outlet lines 4, 6 can be neighbouring and parallel.

In one alternative, the inlet and outlet lines 4, 6 could be coupled with the manifold 2 at different angles, possibly avoiding the need for the inlet line 4 to pass through the upper lumen b1 before reaching the lower lumen al as shown in FIG. 2. In another alternative, intermediate threaded saddle pieces or other connecting pieces could be welded onto and/or into the manifold 2, to which separate delivery lines could then be coupled. For example, and as shown in FIG. 2, the inlet line 4 could be made from two pieces, a main delivery line 5*a* and an infill tube piece 5*b*. Aligned holes are formed in the manifold wall and the partitioning member 8, into which the infill piece 5*b* is fitted. An interference fit between the lower end of the infill piece 5*b* and the partitioning member 8 may be sufficient to effect a seal therebetween. The infill piece 5*b* can be secured in place by welding its upper end with the surrounding manifold wall. The main delivery line 5*a* can then be welded or otherwise coupled to said upper end.

Figure 7:
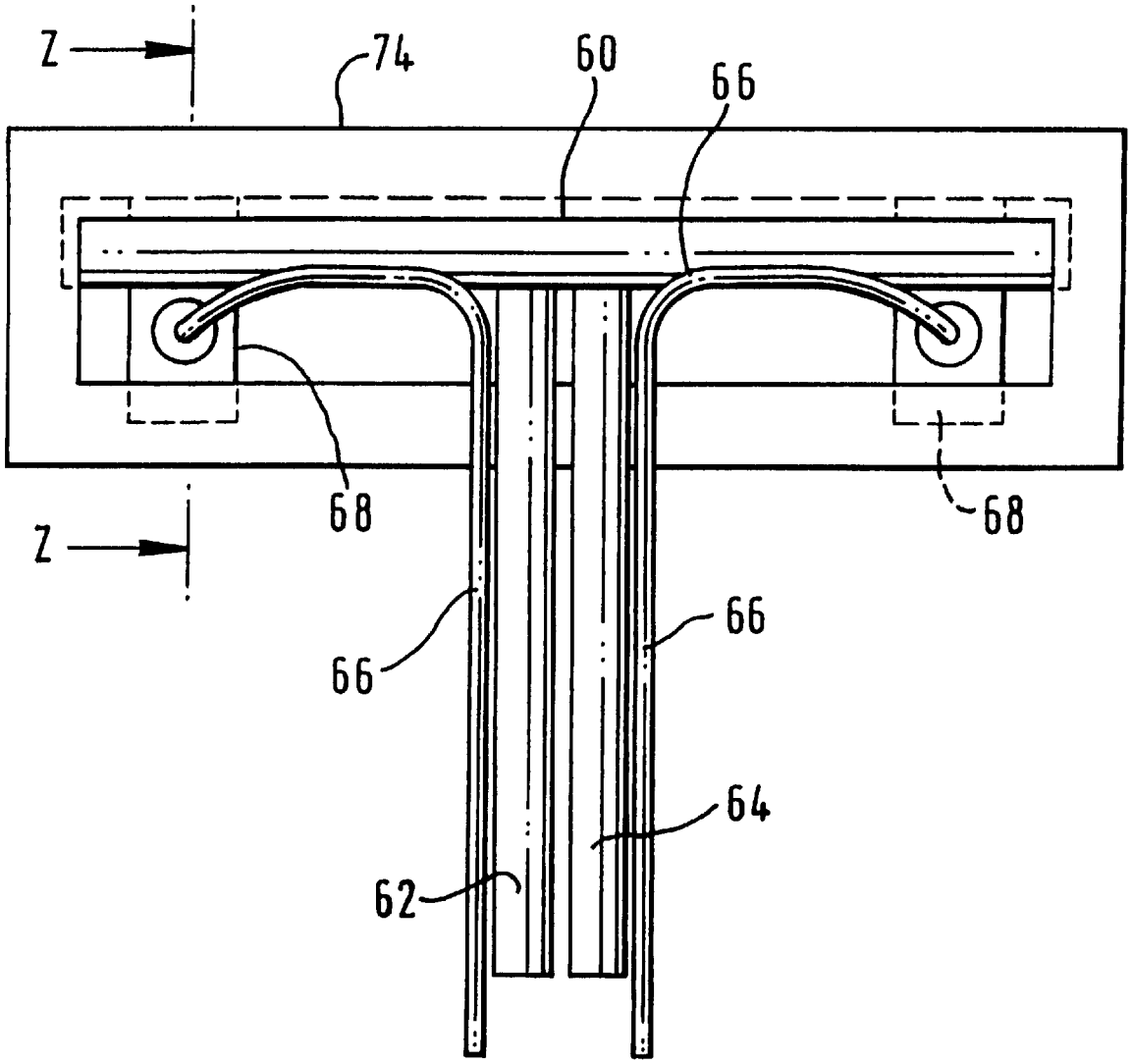
FIG. 7 is a back view of a tower cooling assembly according to third embodiment of the present invention.
Figure 8:
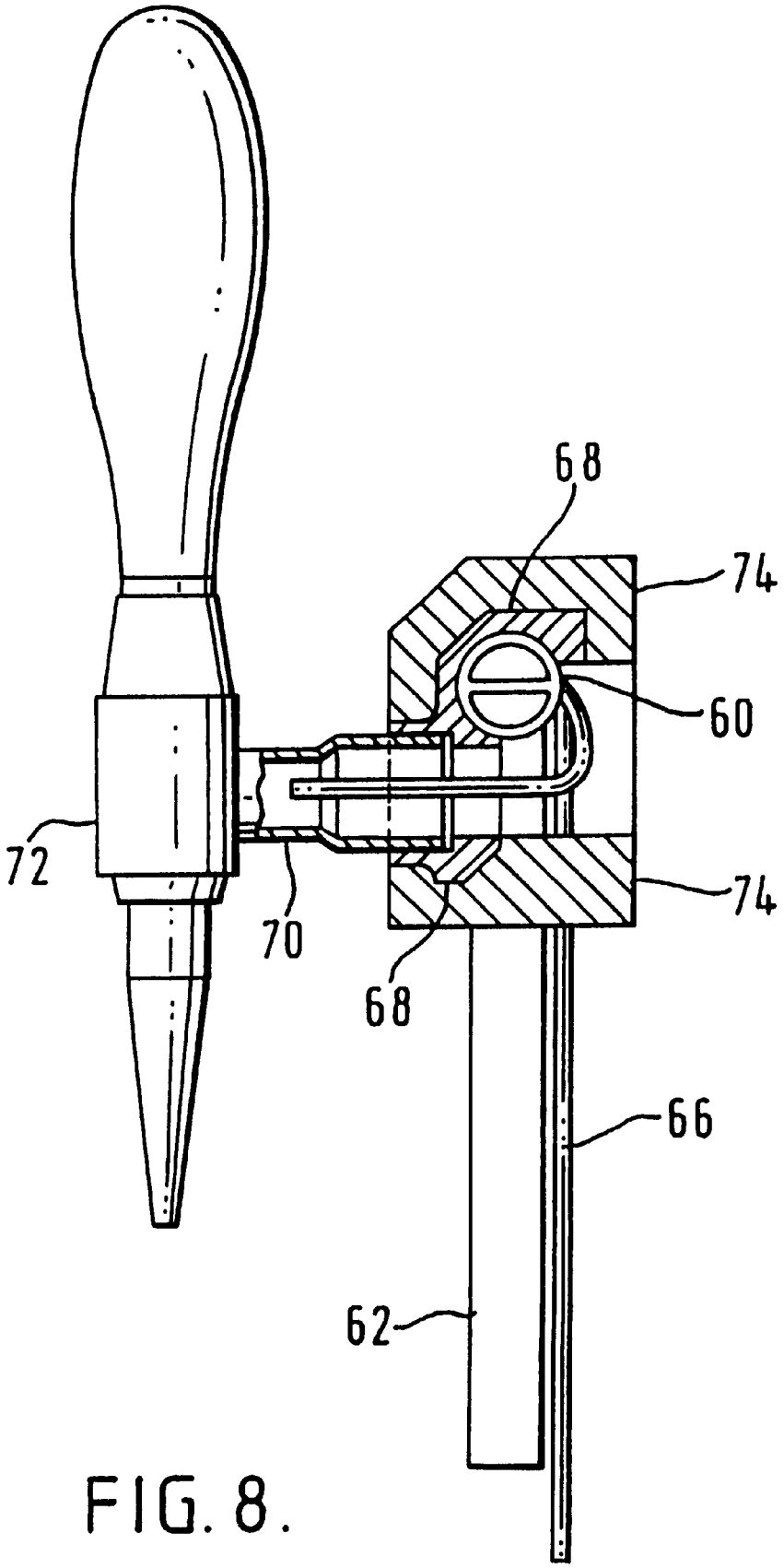
FIG. 8 is a cross-sectional along line Z—Z in FIG. 7.

The manifold 2 as shown in FIG. 1 could be used for the circulation of a coolant to provide cooling to the surroundings, further described hereafter with reference to FIGS. 7 and 8. Alternatively, branch pieces, as exampled in FIG. 3, could be added along one side of the manifold 2 to create a liquid distributing manifold for beverages such as water or beer. Such a manifold is suitable for use in a beverage distribution tower commonly used for post-mix multiple drinks vending assemblies.

As shown in FIGS. 1–3, inflowing liquid from the inlet line 4 passes directly into the lower lumen al and is circulated by pressure to both ends of the manifold 2, and hence through the common passages 13 into the upper lumen b1. Any beverage to be distributed can then be drawn off through a branch line 14 as shown in FIG. 3.

Due to the guided flow of the liquid by the partitioning member 8, there are no areas of possible stagnation in the manifold 2. Each branch line 14 receives liquid of equal quality and consistency. Any remaining flow of liquid in the upper chamber b1 then egresses through the outlet line 6.

Figure 4:
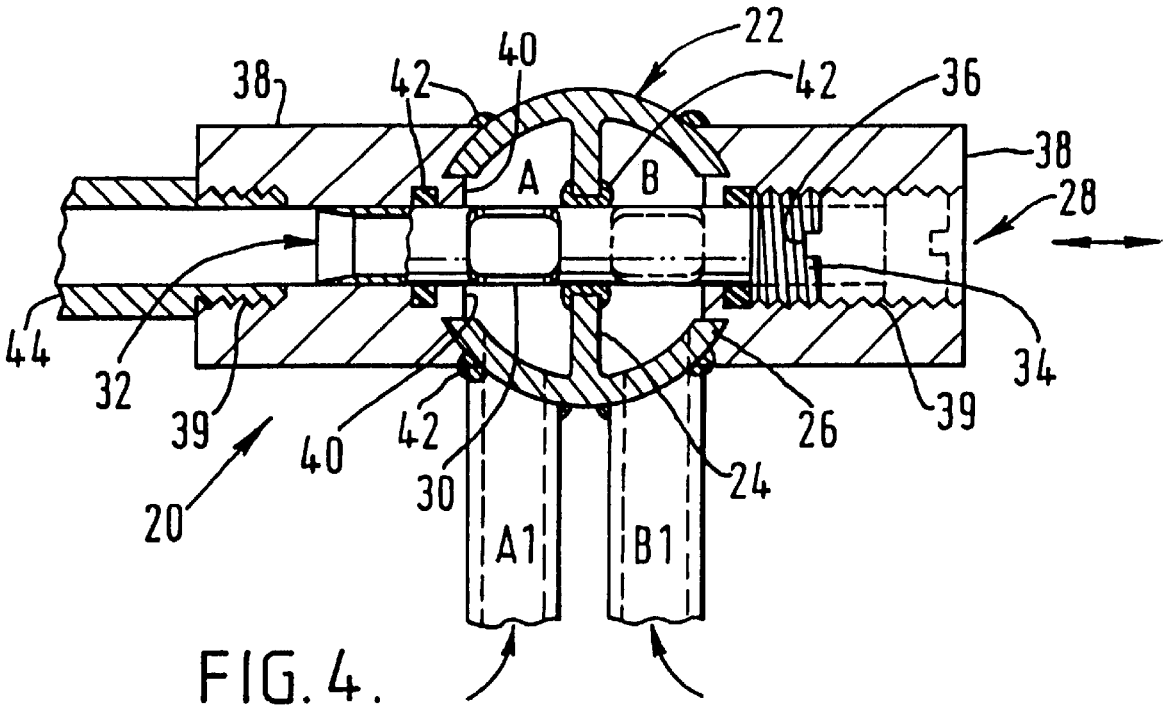
FIG. 4 is a cross-sectional side view of a gated valve assembly on a beverage distributing manifold according to a second embodiment of the present invention.
Figure 5:
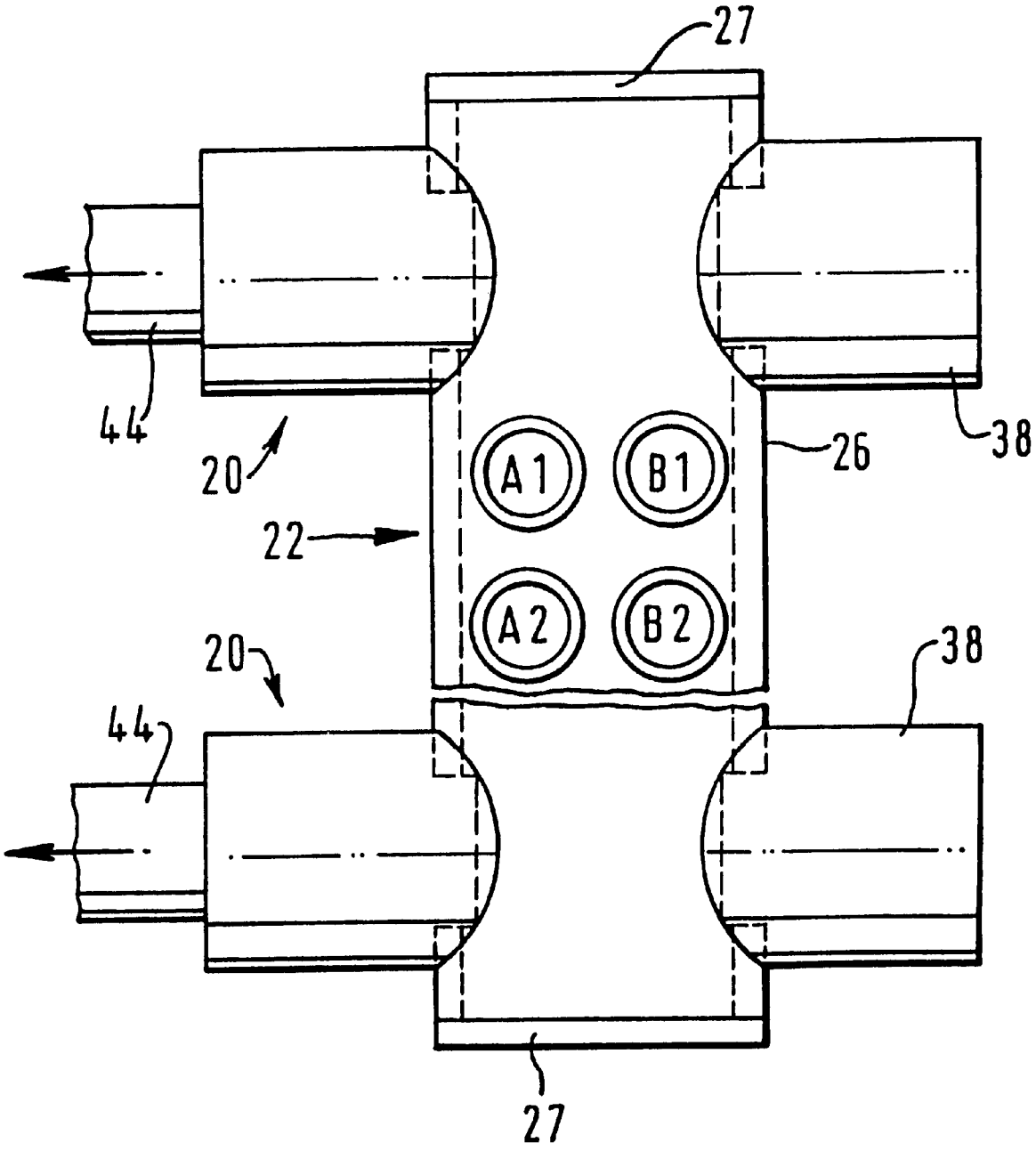
FIG. 5 is a base view of the manifold in FIG. 4 with two valve assemblies.

FIGS. 4 and 5 shows a gated valve assembly 20 for use with a beverage distributing manifold 22. The manifold 22 is similar to that shown in FIG. 1, wherein a partitioning member 24 is integrally formed within and wholly along the main body 26 of the manifold 22 by extrusion. However, by welding end caps 27 directly onto each end of such a main body 26, separate left and right longitudinal lumens, A and B respectively, are created. The lumens A, B are effectively sealed from each other, allowing separate liquids to flow in each lumen A, B.

As shown in FIG. 5, each lumen A, B has its own separate inlet and outlet delivery lines, labelled A1, B1 and A2, B2 respectively, The two liquids could be e.g. still and carbonated water, or two types of beer. The inlet and outlet lines need not be parallel or neighbouring, if some sort of flow along each lumen is desired.

The valve assembly 20 has a hollow cylindrical body 28 having an inlet 30 in the side of the body 28, and an outlet 32 being one end of the body 28. The other end of the body is sealed by an end cap 34 having an outwardly facing slot 36.

The ends of the body 28 are housed and guided by two collar pieces 38 welded on opposing sides of the manifold 20. The collar pieces 38 have shoulders 40 to fit into opposing apertures in the manifold wall. The partitioning member 24 also has an aligned aperture through which the valve body 28 can pass. Seals 42 are added or effected between the valve body 28, the partitioning member 24 and the collar pieces 38 where they meet. The collar pieces 38 have internal screw threads 39. The end cap 34 on the valve body 28 has a correspondingly screw thread, and is rotatable (using a screwdriver on the slot 36) within and along its collar piece 38.

In the thread of the other collar piece 38, a suitable connection piece 44 can be added to connect to a valve, tap or other beverage distribution port.

Rotation of the end cap 34 effects lateral rotational movement of the whole valve body 28 transversely within the collar pieces 38 and manifold 20, and thus movement of the inlet 30 to locate it in either lumen. FIG. 4 shows the inlet 30 in lumen A, with its possible position in lumen B in dashed line. The position of the valve body 22 could be set before the entrance of liquids into the lumens, or during temporary drainage thereof. Alternatively, the valve body could be moved during use of the manifold, which may possibly require some liquid to be purged to clear the valve body and subsequent piping of the first liquid. The inlet 30 as shown in FIG. 4 is such that mixing of the liquids in the two lumens A, B is possible with the inlet 30 situated across the partitioning member 24.

The gated valve assembly allows the installation of one manifold to provide the choice of two or more different liquids for each branch therefrom. Thus, the number of branches able to deliver e.g. either still or carbonated flavoured drink could be pre-set according to the particular location, and changed at any time to accommodate changing demand. The valve body is housed within the manifold, minimising the space required, and reducing complexity of installation.

Whilst FIG. 5 shows a manifold 22 having only two valve assemblies 20 as branch outlets, this is by way of example only; beverage distribution manifolds usually have a greater number of branch outlets, e.g. six.

Figure 6:
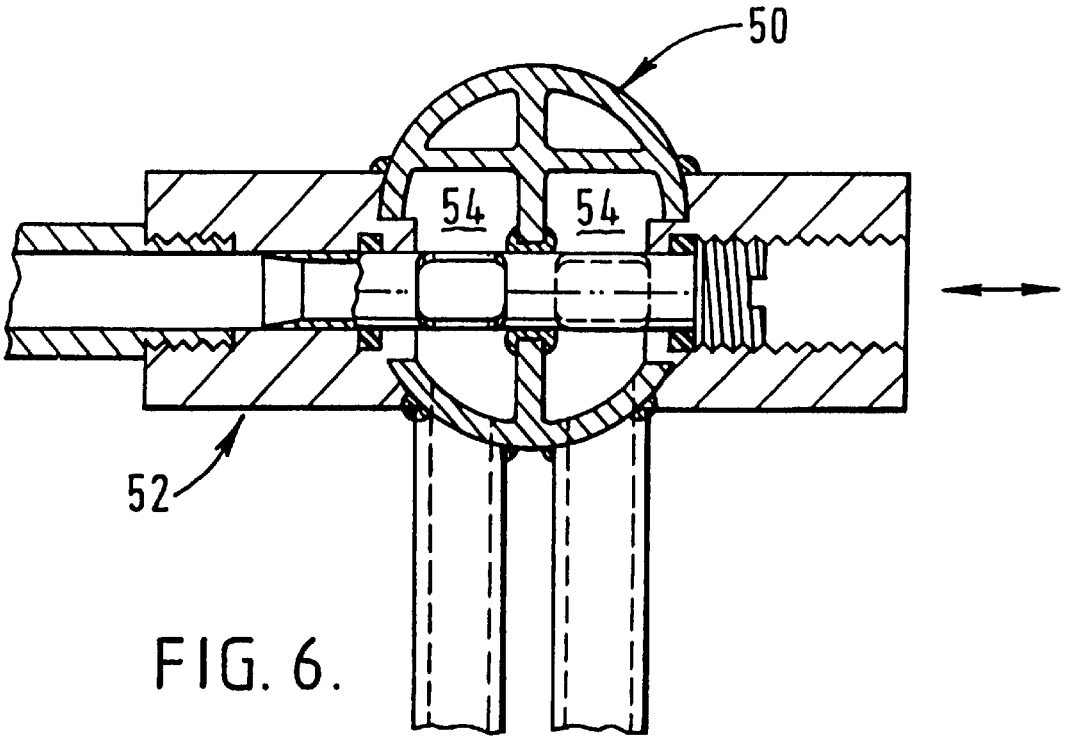
FIG. 6 is a cross-sectional side view of a four-lumen beverage distributing manifold with a gated valve assembly.

FIG. 6 shows a four-lumen beverage distribution manifold 50 with a similar gated valve assembly 52. The valve acts as described above with reference to FIG. 4, with each lumen divided into two further lumens to provide circulated flow along the lower distributing lumens 54, as described above with reference to FIGS. 1-3. Each upper and lower lumen are connected to each other only, and the inlet and outlet lines are also coupled as shown in FIGS. 2 and 3.

The embodiment shown in FIG. 6 combines the benefits of the embodiments shown in FIGS. 1–5.

FIGS. 7 and 8 show a tower cooling assembly adapted to provide cooling to its surroundings. The assembly has an internally divided cooling manifold 60 as described above with an inlet line 62 and an outlet line 64. A cooling liquid, eg. chilled water, is circulated around the manifold 60 as hereinbefore described.

Trace cooling is provided to two delivery lines 66 as they run adjacent to the inlet and outlet lines 62, 64 and the manifold 60. Cooling of the taps 72 (only shown in FIG. 8) is also effected by metal ferrules 68 set between the manifold 60 and the taps shafts 70. Preferably, the taps shafts 70 connect directly with the metal ferrules 68, eg. by screw thread.

The metal ferrules 68 provide direct conductive cooling from the manifold 60 to the tap shafts 70 and taps 72, thus extending the cooling effect as far as possible along the passage of the liquid, e.g beer, being dispensed. The ferrules 68 are preferably aluminium. Similar ferrules could be added around the manifolds shown in FIGS. 1, 4, 5 and 6 to effect similar tap cooling from any chilled liquid in such manifolds.

The ferrules 68 could have a snap fit onto the manifold 60, and/or be able to slide along the manifold 60 to be aligned with the desired position of the taps. Once set in place, the manifold 60 and ferrules 68 are surrounded and held together by a rigid polyurethane insulation foam surround 74, which provides insulation and stiffness. The manifold 60, ferrules 68 and surround 74 form an integral and completed cooling assembly ready for installation into a dispensing tower. No internal fitting within the tower is then necessary, other than installation of the product supply lines.

The divided manifold of the present invention provides circulation benefits of directed flow around the manifold, with ease of manufacture, eg. simple plastics extrusion and welding. This method of manufacture also conveniently makes a manifold for the gated valve assembly, providing flexibility of choice within one manifold. Such manifolds are not relatively bigger than existing manifolds so that they are therefore ready to be installed in existing manifold housings such as tower units.

The gated valve assembly may be formed by injection moulding rather than by extrusion and welding.

Variations and modifications can be made without departing from the scope of the invention described above and as claimed hereinafter.

The foregoing relates to preferred exemplary embodiments of the invention, it being understood that other variants and embodiments thereof are possible within the spirit and scope of the invention, the latter being defined by the appended claims.

I claim:

1. A manifold having closed ends, one or more inlets and one or more outlets and an elongate hollow core extending through the manifold, the inlets and outlets being peripheral of the core, the hollow core being divided longitudinally into a plurality of lumens by one or more elongate partitioning members extending across the manifold core to leave a passage at each end to enable liquid flowing in the manifold to be directed laterally around the manifold from the or each inlet to the or each outlet.

2. A manifold according to claim 1, wherein by dividing the manifold longitudinally along its core, liquid flowing in the manifold is directable laterally from one end to the other, or at least along and across the apertures for any branch outlets, avoiding stagnation and equalizing distributing temperature and pressure.

3. A manifold according to claim 1, wherein the or each partitioning member is separate or integral with the manifold, supported in place by the manifold body wall, either directly or with intermediate supporting means.

4. A manifold according to claim 3, wherein where separate, the or each partitioning member is readily and easily insertable into one end of the manifold which is then sealed.

5. A manifold according to claim 4, wherein a separate partitioning member is supported in place across the core by interference fit with the manifold wall.

6. A manifold according to claim 1, wherein the partitioning member(s) are formed integrally with the main body of the manifold.

7. A manifold according to claim 6, wherein the body of the manifold and the or each said partitioning member is integrally formed by plastics extrusion.

8. A manifold according to claim 7, wherein the or each partitioning member is inherently supported in place by the manifold body wall.

9. A manifold according to claim 1, wherein the manifold uses one partitioning member, which, depending upon its shape is able to divide the manifold core into said plurality of lumens.

10. A manifold according to claim 9, wherein the manifold includes two or more separate lumens or sets of lumens, each separate lumen or each set of lumens is provided with a separate inlet and outlet.

11. A manifold according to claim 10, wherein more than one inlet and/or more than one outlet is used for each lumen or each set of lumens.

12. A manifold according to claim 1, wherein each lumen is separate from each other lumen, and is able to direct liquid flow into one or more other lumens through common passages.

13. A manifold according to claim 1, wherein the or each partitioning member includes slits, perforations or other apertures therein to increase or disturb the flow of liquid to and/or around the or each neighbouring lumen.

14. A manifold according to claim 1, wherein the or each partitioning member is extended wholly or substantially along the length of the manifold core.

15. A manifold according to claim 1, wherein where a partitioning member extends only substantially along the length, liquid flows into one or more other lumens within the remaining common passage in the core.

16. A manifold according to claim 1, wherein where a partitioning member extends to the ends of the manifold core, and the passage of liquid to one or more other lumens, apertures are created in the one or both ends of the members, or one or both ends of the members are cut away, to allow such flow.

17. A manifold according to claim 1, wherein the manifold has one inlet coupled to one or more lumens, and one outlet coupled to at least one different but connected lumen.

18. A manifold according to claim 17, wherein the inlet(s) and outlet(s) are positioned anywhere around or along the manifold, either separately or neighbouring.

19. A manifold according to claim 18, wherein the or each inlet and the or each corresponding outlet are neighbouring and parallel.

20. An integral tower cooling assembly comprising an internally divided cooling manifold according to claim 1, and one or more conjoined metal ferrules adapted to connect with and supply cooling to one or more dispensing taps, the manifold and the or each ferrule being held together by a rigid insulative surround.

21. A manifold according to claim 1, having a gated valve assembly adapted for use with a beverage distributing manifold having a plurality of longitudinally separate lumens, wherein the valve assembly includes a hollow body having an inlet and an outlet for the passage of liquid therethrough to a distribution port, the valve body being transversely movable within and across the manifold to separately locate the inlet in each lumen.

22. A manifold according to claim 21, wherein the gated valve assembly allows the separate passage of the liquid in each lumen to the outlet of the valve body, and hence to the distribution port.

23. A manifold according to claim 21, wherein one manifold supplies two or more different beverages, and the supply to each distribution port is alterable as desired or necessary.

24. A manifold according to claim 21, wherein the inlet of the valve body is smaller than the transverse width of each lumen.

25. A manifold according to claim 24, wherein the inlet is smaller than the separation between the lumens, to prevent any flow between the lumens when moving the valve body.

26. A manifold according to claim 24, wherein the inlet is sized and/or shaped so as to allow the passage of liquid from two or more lumens simultaneously.

27. A manifold according to claim 21, wherein the valve assembly is supported by housing on one or both sides of the manifold.

28. A manifold according to claim 27, wherein the distribution port is coupled to the housing, and the housing supports and guides movement of the valve body.

29. A manifold according to claim 21, for use with the gated valve assembly, wherein the manifold is divided longitudinally by one or more elongate partitioning members across the manifold core to create the lumens as described hereinbefore.

30. A manifold according to claim 21, wherein the manifold and gated valve assembly is made from any suitable material or combination of materials.

31. A manifold according to claim 30, wherein the manifold and gated valve assembly are made of plastic materials.

32. A manifold according to claim 31, wherein the plastic components are welded together using known welding techniques.

33. A manifold according to claim 31, wherein the gated valve assembly is injection moulded from plastics materials.

34. A manifold having closed ends and an elongate hollow core extending therethrough, one inlet and one neighboring and parallel outlet peripheral of the core, and a partitioning member integrally formed across and substantially along the length of the manifold core to leave a passage at each end to create two lumens with connecting ends, wherein the inlet is coupled to one lumen and the outlet is coupled to the other lumen.

35. A manifold according to claim 34, wherein the manifold is used to distribute a beverage to a plurality of branch outlets, apertures to which are spaced in the manifold body along the side of one lumen.

36. A manifold according to claim 35, wherein the manifold is also used to circulate a coolant around the manifold to cool the surrounding environment, neighbouring components and/or neighbouring liquids.

37. A manifold according to claim 36, wherein the cooling includes trace cooling of any adjacent supply lines, and conduction cooling of a beverage dispensing head or tap through use of metal blocks or ferrules thereinbetween.

38. A manifold according to claim 37, wherein the dispensing heads or taps attach or connect directly with the metal blocks or ferrules, and the blocks or ferrules fit wholly or substantially around the manifold.

* * * * *